US010283295B2

(12) United States Patent
Mochizuki et al.

(10) Patent No.: US 10,283,295 B2
(45) Date of Patent: May 7, 2019

(54) PROTECTION DEVICE

(71) Applicant: Littelfuse Japan G.K., Kawasaki-shi (JP)

(72) Inventors: Hirofumi Mochizuki, Ryugasaki (JP); Arata Tanaka, Ryugasaki (JP)

(73) Assignee: Littelfuse Japan G.K., Motoasaka, Minato-Ku, Tokyo (JP)

( * ) Notice: Subject to any disclaimer, the term of this patent is extended or adjusted under 35 U.S.C. 154(b) by 179 days.

(21) Appl. No.: 14/785,316

(22) PCT Filed: Apr. 17, 2014

(86) PCT No.: PCT/JP2014/060950
§ 371 (c)(1),
(2) Date: Oct. 16, 2015

(87) PCT Pub. No.: WO2014/171515
PCT Pub. Date: Oct. 23, 2014

(65) Prior Publication Data

US 2016/0086753 A1 Mar. 24, 2016

(30) Foreign Application Priority Data

Apr. 19, 2013 (JP) ..... 2013-088684

(51) Int. Cl.
*H01H 37/52* (2006.01)
*H01H 37/34* (2006.01)
(Continued)

(52) U.S. Cl.
CPC ..... *H01H 37/52* (2013.01); *H01H 37/34* (2013.01); *H01H 37/46* (2013.01);
(Continued)

(58) Field of Classification Search
CPC ..... H01H 37/52; H01H 37/5427; H01H 37/5436; H01H 37/34; H01H 37/46; H01H 2037/5463; H01H 2037/5481
(Continued)

(56) References Cited

U.S. PATENT DOCUMENTS 2,264,276 A 12/1941 Clark
3,825,868 A * 7/1974 Jess ..... H01H 37/12 174/650
(Continued)

FOREIGN PATENT DOCUMENTS

JP S62209381 A 9/1987
JP 1137034 A 9/1989
(Continued)

OTHER PUBLICATIONS

Shibuya (JP 2005203277) machine translation.*
International Search Report for International Application No. PCT/JP2014/060950, dated Jul. 15, 2014.

*Primary Examiner* — Jacob R Crum

(57) ABSTRACT

The present invention provides a protection device including a bimetal component and a PTC component. This protection device includes a resin base, a first terminal, a second terminal, a PTC component, a bimetal component, an arm, an upper plate and a resin cover. A portion of the first terminal configures a first electrode, and a portion of a second terminal configures the second electrode, and the first electrode and the second electrode are exposed outward at the bottom surface of the resin base. In a normal state, the first terminal, the arm and the second terminal are electrically connected in series. When the bimetal component is activated, the first terminal and the arm become electrically cut off while the first terminal, the PTC component, the
(Continued)

bimetal component, the arm and the second terminal are electrically connected in series in the mentioned order.

12 Claims, 3 Drawing Sheets

(51) Int. Cl.
*H01H 37/46* (2006.01)
*H01H 37/54* (2006.01)

(52) U.S. Cl.
CPC . *H01H 37/5427* (2013.01); *H01H 2037/5463* (2013.01); *H01H 2037/5481* (2013.01)

(58) Field of Classification Search
USPC ..... 337/377
See application file for complete search history.

(56) References Cited

U.S. PATENT DOCUMENTS 4,152,998 A * 5/1979 Taylor ..... G01K 5/68 29/622
5,607,610 A * 3/1997 Furukawa ..... H01H 1/504 219/488
5,867,084 A * 2/1999 Hofsass ..... H01H 37/5427 337/327
5,867,085 A * 2/1999 Kruck ..... H01H 11/0056 337/333
6,100,483 A * 8/2000 Horie ..... H01H 3/001 200/329
6,191,928 B1 * 2/2001 Rector ..... H01C 7/006 361/111
6,396,381 B1 * 5/2002 Takeda ..... H01H 1/504 337/342
6,498,559 B1 * 12/2002 Cornell ..... H01H 37/54 29/623
6,503,647 B1 * 1/2003 Sugiyama ..... H01M 2/202 429/61
7,075,403 B2 * 7/2006 Unno ..... F04C 23/008 337/343
2002/0140401 A1 10/2002 Watanabe et al.
2003/0074974 A1 4/2003 Davis et al.
2003/0122650 A1 7/2003 Yamamoto et al.
2006/0197647 A1 * 9/2006 Whitney ..... H01H 85/0418 337/297
2010/0081015 A1 * 4/2010 Kim ..... H01M 2/0404 429/7
2011/0140827 A1 * 6/2011 Suzuki ..... H01C 13/02 337/362
2012/0133478 A1 * 5/2012 Chiu ..... H01H 85/165 337/228

FOREIGN PATENT DOCUMENTS

JP 2003-178659 A 6/2003
JP 2005-203277 A 7/2005
JP 2006-031956 A 2/2006
JP 2006-331705 A 12/2006
JP 2011-134624 A 7/2011
JP 2011-233314 A 11/2011

* cited by examiner

PROTECTION DEVICE

FIELD OF THE INVENTION

The present invention relates to a protection device which substantially interrupts a current through an electrical or an electronic apparatus (for example, a motor or a secondary cell pack) when such a current excessively flows through the apparatus or when a temperature of the electrical or electronic apparatus or an ambient temperature thereof rises excessively.

BACKGROUND OF THE INVENTION

When an abnormality occurs, for example, when a current excessively flows through an electrical apparatus (for example, a motor) and thereby causes the electrical apparatus to leach an abnormally high temperature or when the electrical apparatus reaches an abnormally high temperature due to some reason other than the excessive current, it is needed to secure a safety of the electrical apparatus by interrupting the current flowing through the electrical apparatus and eliminating the abnormality when necessary. A bimetal component is used as a means to interrupt the current as described above.

The bimetal component comprises a sheet member of a bimetal metal. The bimetal component is configured to be activated (i.e. deformed) so as to interrupt a current flowing through the bimetal component when the bimetal component itself reaches a higher temperature in excess of a predetermined temperature, or when the bimetal component reaches a higher temperature in excess of a predetermined temperature due to arise in the temperature of an ambient atmosphere of the bimetal component.

When such bimetal component is incorporated in an electrical apparatus, it is activated when the electrical apparatus leaches an abnormal temperature clue to an excessive current or some other reason, so that the current is ink. The temperature of the electrical apparatus decreases by the interruption of the current. Since the temperature of the bimetal component also decreases, the bimetal component returns to its original shape (i.e. it recovers), as a result of which the current may be allowed to flow again before the safety of the electrical apparatus is secured.

In order to prevent the current from flowing again as described above, it is necessary to ensure and maintain the state when the bimetal are activated. For this purpose, the bimetal component is disposed in series in a circuit of the electrical apparatus so that it can interrupt the circuit current, while at the same time a PTC component is disposed in parallel to the bimetal component. By such arrangement, when the bimetal component is activated, the current flowing through it is diverted to the PTC component the PTC component generates a Joule heat by the current and this heat is transmitted to the bimetal component so that the activated state of the bimetal component can be ensured.

A protection device is known which is configured so that a movable contact which is operated by the bimetal component is disposed in series in the electrical circuit and the PTC component is disposed in parallel to the bimetal component as described above. Such a protection device is disclosed, for example, in Patent Reference 1 shown below. In such a protection device, a resin base having a terminal comprises a PTC component, a bimetal component and an arm within a space provided in the resin base; a cover which is previously provided with an upper plate is placed on the resin base, and the resin base and the resin cover in this state are bonded with an adhesive or by ultrasonic fusion to form a resin housing. In such protection device, the terminal and the atm protrude from the resin housing.

JP-A 2005-203277 is a prior patent reference.

SUMMARY OF THE INVENTION

The conventional protection device as mentioned above is electrically connected to a prescribed electrical element via portions of the terminal and the arm, and each of the connecting of the terminal and the arm needs to be separately performed and a space for connecting is needed since the terminal and arm protrude.

As a result of intensive studies by the inventors of the present invention, it has been found that the problem described above can be solved by a protection device comprising a resin base, a first terminal, a second terminal, a PTC component, a bimetal component, an arm, an upper plate and a resin cover wherein a portion of the first terminal configures a first electrode, and a portion of a second terminal configures the second electrode, the first electrode and the second electrode are exposed outward at a bottom surface of the resin base, in a normal state, the first terminal, the arm and the second terminal are electrically connected in series, when the bimetal component is activated, the first terminal and the arm become to be electrically cut off while the first terminal, the PTC component, the bimetal component, the arm and the second terminal are electrically connected in series in thus mentioned order.

According to the present invention, with the protection device comprising the resin base, the first terminal, the second terminal, the PTC component, the bimetal component, the arm, the upper plate and the resin cover a protection device which is surface mountable can be provided, in one embodiment, by extending the first terminal and the second terminal around the side surface of the resin base to the bottom surface of the resin base, for example in a U-shape so as to form the first electrode and the second electrode such that they are exposed outward on the bottom surface of the resin base.

DETAILED DESCRIPTION OF THE INVENTION

Figure 1:
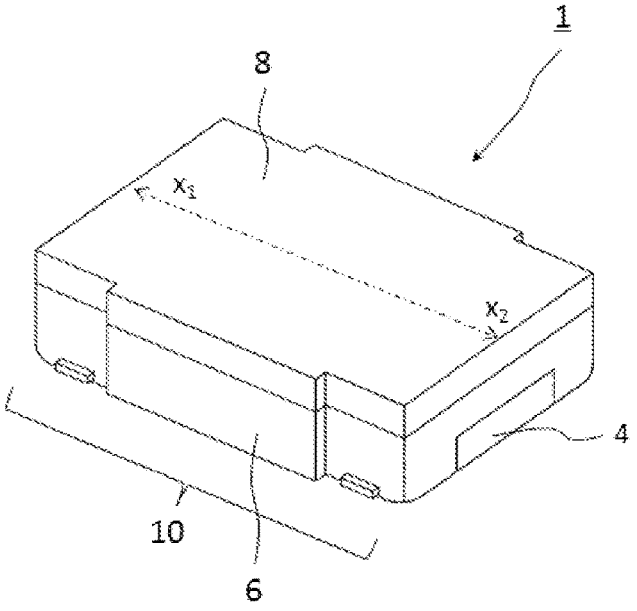
FIG. 1 schematically shows the protection device 1 of the present invention in its perspective view.
Figure 2:
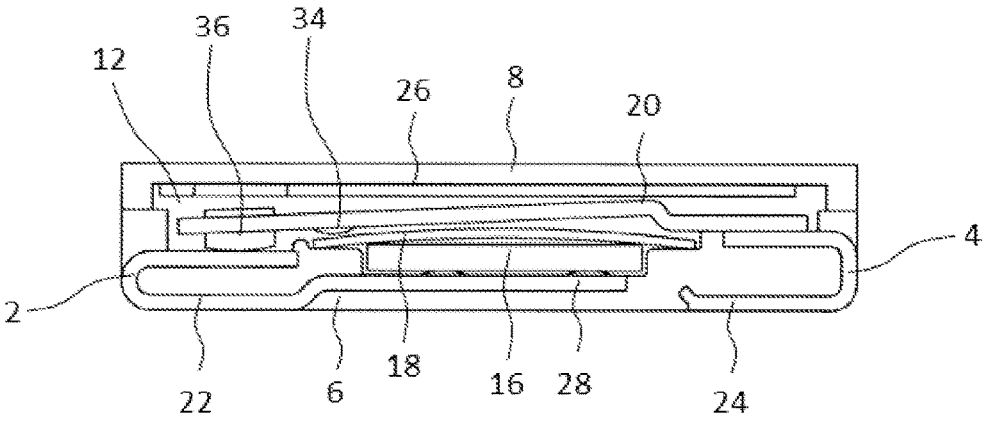
FIG. 2 schematically shows the protection device shown in FIG. 1 in its cross-sectional view along a surface perpendicular to a plane including a line $x_1$-$x_2$.
Figure 3:
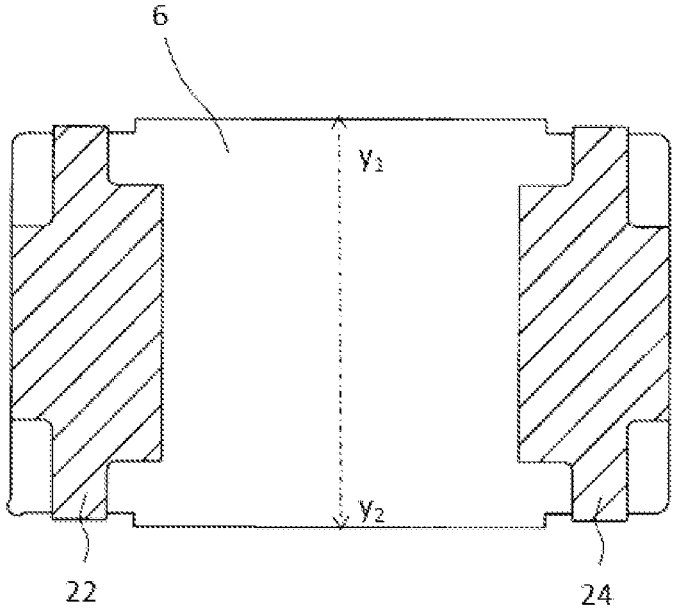
FIG. 3 schematically shows the protection device of the present invention in its bottom view.
Figure 4:
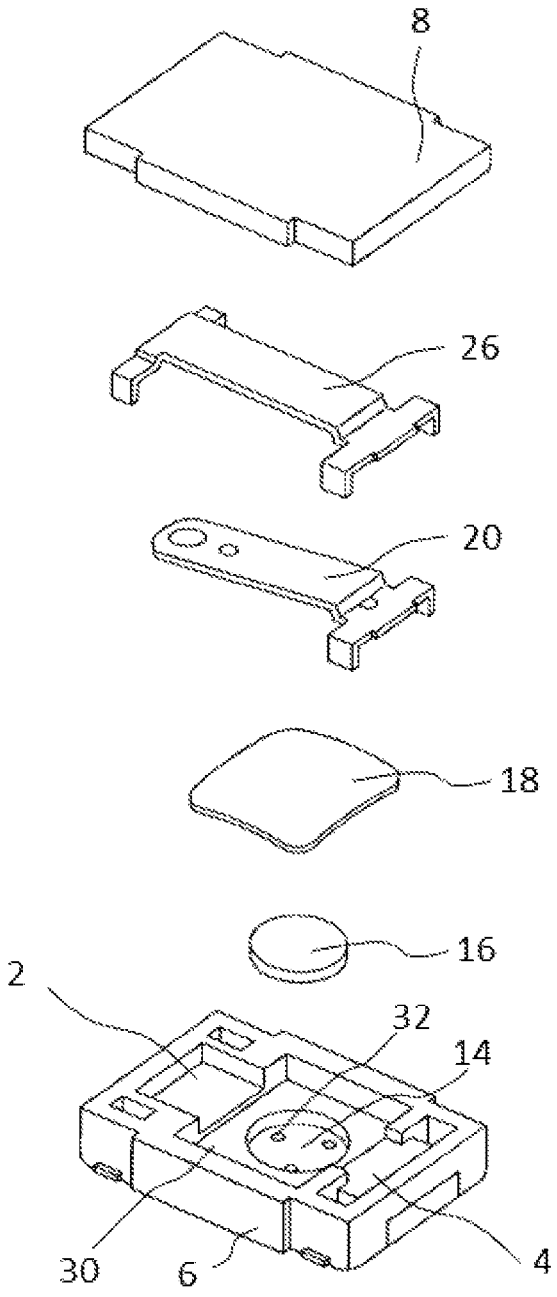
FIG. 4 schematically shows the protection device shown in FIG. 1 in its exploded perspective view when the protection device is hypothetically broken down into its structural elements.

A protection device 1 in one embodiment of the present invention will be described in detail with reference to the accompanied, drawings. It is noted that though FIG. 4 schematically shows a state in which the protection device shown in FIGS. 1-3 is broken down into its structural elements, FIG. 4 schematically shows the protection device 1 of the present invention in its exploded perspective view when the protection device which is completed as a device is hypothetically broken down into its structural elements, and it does not necessarily mean that the protection device of the device invention is obtained by the assembling of these elements shown in FIG. 4.

The protection device 1 of the present invention generally has a structure as shown in FIGS. 1-4. In particular, the protection device 1 has a resin housing 10 which is defined by a resin base 6 having a first terminal 2 and a second terminal 4 as well as a resin cover 8. The resin base 6 has a space 12 whew a portion of the first terminal 2 is exposed at the bottom of the space, a PTC component 16 is disposed on the exposed portion 14, a bimetal component 18 is disposed over the PTC component 16, an arm 20 is disposed on or over the bimetal component 18, and an upper plate 26 is disposed over the arm 20. One end of the arm 20 is electrically connected to the second terminal 4. A portion of the first terminal and a portion of the second terminal extend around the side surface to the bottom surface of the resin housing 10 and become exposed to the outside of the protection device at the bottom surface to form the first electrode 22 and the second electrode 24, respectively. The first electrode 22 and the second electrode 24 are exposed outward at the bottom surface of the resin base, thus, the first electrode 22 and the second electrode 24 lie in the same plane. The space 12 including the exposed portion 14 of the first terminal, the PTC component 16, the bimetal component 18, the arm 20 and the upper plate 26 is covered and sealed with the resin cover 8.

In the protection device 1, the first terminal 2, the arm 20 and the second terminal 4 are electrically connected in series in a normal state. The bimetal component 18 is in an upwardly convex state (a convex state toward the arm) as illustrated, and is separated from the arm 20. In this state, a current flows though and in the order of the first terminal 2, the arm 20 and the second terminal 4 (or the reverse order), and the current does not flow through the PTC component 16 or the bimetal component 18. In an abnormal state, i.e. when an abnormal heat generation occurs due to an excessive current or the like, the bimetal component 18 is activated and deforms into a downward convex from the upward convex, as the result of which the arm 20 is pushed upwardly and the electrical connection between the arm and the first terminal is cut off. The deformed bimetal component 18 contacts the arm 20 while connecting to the PTC component 16 and becomes to be in a state of electrically connecting to the arm 20. In this state, the current flows through and in order of the first terminal 2, the PTC component 16, the bimetal component 18, the arm 20, and the second terminal 4 (or the reverse order), and the PTC component trips (acts) by such current and generates Joule heat. The bimetal component 18 is maintained to be in the downward convex state by the Joule heat, so that the opening state of contacts between the arm 20 and the first terminal 2 can be maintained. In this stage, the current flowing though the circuit to be protected is substantively interrupted (however, an extremely small amount of current can flow as a leak current).

In the present invention, the first terminal 2, the second terminal 4 and the resin base 6 are formed to be integral together by insert molding. By using such insert molding, the adhesion between the first terminal 2 as well as the second terminal 4 and the resin base 6 can be enhanced. The resin base 6 has the space 12, and a portion of the first terminal 2 is exposed at the bottom of the space. The PTC component 16 is disposed such an exposed portion 14 of first terminal 2, as a result of which they become to be in a state of electrically connecting to each other. The first terminal 2 may have a plurality of contacts 32, for example three contacts, having for example a domed shape on the exposed portion 14 to ensure an electrical connection with the PTC component 16 easily.

A portion of the first terminal 2 and a portion of the second terminal 4 extend around the side surface to the bottom surface of the resin base 6 such that they are in for example a U-shape, a V-shape (its corner may be round) or the like and are exposed on the outside of the resin base; and such portions km the first electrode 22 and the second electrode 24, respectively. The first electrode 22 and the second electrode 24 are exposed outward on the bottom suffice of the resin base, that is, the exposed surfaces lie in the same plane, so that surface mounting of the device onto a prescribed electrical element becomes easier.

It is preferable that the first electrode 22 and the second electrode 24 are formed such that they are line-symmetric with respect to a centerline ($y_1$-$y_2$ in FIG. 3) between the first electrode and the second electrode at the bottom surface of the resin base 6. By fuming the first electrode 22 and the second electrode 24 as described above, the protection device can be positioned in any orientation without paying attention to identify a positive electrode or a negative electrode, for example, upon mounting the device onto a substrate.

It is preferable that the first electrode 22 and/or the second electrode 24 are plated with a metal which is unsusceptible to oxidation. Similarly, it is preferable that contacts of the first terminal 2 and the arm 20 and/or contacts of the first terminal 2 and the PTC component 16 are plated with the metal which is unsusceptible to oxidation. By plating with such metal, resistance increase of the electrodes and/or the contacts because of the oxidation thereof is prevented when the protection device is heat-treated in a reflow furnace.

Examples of the metal which is unsusceptible to oxidation include, but are not limited to, for example, gold, platinum, silver, mercury, copper, and the like.

In addition, it is preferable that the first terminal 2 and/or the second terminal 4 are plated with a metal having a high thermal conductivity. By plating the first terminal 2 and/or the second terminal 4 with the metal having a high thermal conductivity, for example, heat generated, at the contact between the first terminal and the arm can be efficiently transported to the exposed portion from the resin housing and dissipated.

Examples of the metal having a high thermal conductivity include, but are not limited to, for example, gold, copper, aluminum, magnesium, molybdenum, tungsten, and the like.

The metal used in plating is preferably a metal which is unsusceptible to oxidation and has a high thermal conductivity, for example, gold.

A thickness of the plate is, but not particularly limited to, for example, 0.2-40 μm, and preferably 2-5 μm. By setting the thickness of the plate to not less than 2 μm, heat can be mole efficiently dissipated and oxidation of the electrode and/or contact can be more surely prevented.

In addition, the first electrode 22 and/or the second electrode 24 may be plated with nickel, gold, tin, or the like in order to increase solder wettability.

The plate may be single-layered or multi-layered. For example, a metal having high thermal conductivity may be plated, followed by plating a metal which is unsusceptible to oxidation (two layers); or a metal which has a high thermal conductivity and which is unsusceptible to oxidation may be plated as a single layer. It is preferable to plate with a metal having any two properties of the following three properties:

(i) high oxidation-resistance, (ii) high thermal conductivity, and (iii) high solder wettability. It is more preferable to plate with a metal having all of the three properties.

The first terminal 2 may have a contact part, as a contact part with the arm 20 (not illustrated in the drawings), formed by swaging a contact material into a hole provided through the first terminal 2 to penetrate through it. The term "swaging" as used herein means that into a hole provided through a certain member (for example, a plate for the first terminal), another member (for example, a contact material) having a diameter which is equal to that of the hole and a thickness (height) larger than that of the hole is fitted, and then portions which project upwardly and downward from the hole, respectively, are squashed so as to fix said another member to the certain member. It is noted that the contact material is not necessarily in a circular cylindrical shape, and it may be in a rectangular cylindrical shape or the like. By forming such contact part in the first terminal 2, the contact part can have a larger thermal capacity, as the result of which rapid temperature rise of the contact parts can be presented even when a relatively larger amount of current flows through the protection device, so that the holding current of the protection device can be increased.

The metal constituting the contact material includes, but not particularly limited to, for example, silver-nickel, silver-copper, AgCdO, $AgSnO_2$, AgZnO, AgSnOInO, AgCu, copper-tungsten and the like. A 90% silver-10% nickel alloy is preferable in view that a shape designing of the contact part, in particular fine designing of a thickness is possible clue to its lower hardness.

The first terminal 2 preferably may have a rib on at least a portion of the first terminal, for example on around a section 28. The tam "rib" as used herein means an element or a structure for enhancing strength of a member on which the rib is provided. For example, it includes a reinforcement element having a line shape, a rod shape or a ship shape which is provided on the surface of the member and a structure in which a portion of the surface of the member is deformed to have a convex shape or a concave shape. By forming such rib, a stiffness of the protection device, in particular strength against an external pressure from the back side (from the electrode side) of the device can be enhanced.

The above mentioned terminal 2 is preferably formed such that the section 28 comprising the above mentioned exposed portion 14 is located at a deeper position in the space 12 of the resin base 6. By applying such form, a volume of the space 12 of the resin base 6 can be increased.

Preferably, the resin base 6 is formed of a thermally resistant resin. By using such resin, deformation of the protection device can be prevented even when it is subjected to a high temperature environment such as an environment within a reflow furnace.

Examples of the thermal resistant resin described above include, for example, an LCP resin, a polyamide resin, a PPS resin and the like.

In the protection device of the present invention, the PTC component 16 is disposed on the exposed portion 14 of the first terminal. As a result, the first terminal 2 and the PTC component 16 are electrically connected, for example, via the contact 32.

As the PTC component described above, either a ceramic PTC component or a polymer PTC component may be used, but it is preferable to use the polymer PTC component. The polymer PTC component is advantageous in comparison with the ceramic PTC component in that a resistance of the component itself is lower and a self-destruction is unlikely to occur even when its temperature reaches over a certain temperature. Additionally, as to the polymer PTC component, a voltage required to maintain a tripping state is lower in comparison with the ceramic PTC component, and therefore, the polymer PTC component can maintain the tripping state even when a circuit voltage is low. As the result of this, the polymer PTC component is advantageous in that the contact can be maintained in an open state (latch state), so that chattering which is a phenomenon wherein opening and closing between the contacts are repeated can be prevented. Furthermore, when the holding anent values are same between the ceramic PTC component and the polymer PTC component, the polymer PTC component is preferable in that it has a smaller size and has a lower resistance relative to the ceramic PTC component.

The above mentioned polymer PTC component comprises a laminate PTC element which is formed by extruding an electrically conductive composition containing a polymer (for example, polyethylene, polyvinylidene fluoride, or the like) in which an electrically conductive filler (for example, carbon black, nickel alloy, or the like) is dispersed, and electrodes (for example, metal foils) which are disposed on both sides thereof.

The size and shape of the polymer PTC component are not particularly limited. In the protection device of the present invention, for example, the PTC component which is in a disk shape having a diameter of 2.0 mm or less, and a thickness of 0.20 mm or less can be used.

When the polymer PTC component is used as the PTC component in the protection device of the present invention, its resistance value is preferably 0.8-10Ω and more preferably 4.5-10Ω. By setting the resistance of the polymer PTC component to 0.8Ω or more, the tripping state can be maintained with 3 V. By setting the resistance of the polymer PTC component to 4.5Ω or more, the leak current can become 0.2 A or less in the tripping state at 3 V. By setting the resistance of the polymer PTC component 10Ω or less, a variation in the resistance in producing of the polymer PTC component can easily be reduced.

It is noted that the resistance value of the polymer PTC component in the present specification means a resistance value (measured by four-terminal method, applied current of a measurement range of a resistance measurement equipment 100 mA) which is calculated from an applied voltage and a current value which is measured when the applied voltage of 6.5 mV (direct current) is applied at 25° C. between both electrodes of a PTC component which is produced by the pressure-bonding of electrodes (preferably, nickel foils) on both sides of a PTC element obtained by the extrusion of an electrically conductive composition comprising a polymer. It is noted that since a resistance value of the electrodes is negligibly small in comparison with the resistance value of the PTC element, the resistance value of the PTC component is substantially equal to the resistance value of the PTC element.

In the protection device of the present invention, the bimetal component 18 is disposed over the PTC component 16. The bimetal component 18 is supported on a step part 30 provided in the space 12. The bimetal component 18 is not particularly limited as long as it deforms at a temperature which is determined to be abnormal, and a bimetal component known per se can be used. Though the bimetal component 18 may or may not be electrically connected to the NC component in a normal state, the bimetal component 18 is electrically connected to the PTC component in the abnormal state.

As long as the space 12 of the resin base permits the bimetal component 18 preferably has a large surface area as much as possible. By having a larger surface area, a variation of an activating temperature of the bimetal component can be reduced, and a force is increased which pushes the arm 20 upwardly when it deforms in the abnormal state.

The bimetal component 18 can be obtained, for example by singly pressing the bimetal component so as to be in a desired shape, followed by heat-treated at a high temperature. An activating temperature of the bimetal component thus heat-treated is an activating temperature of the protection component. The temperature property of the protection device using such a bimetal component does not change and the protection device can act at a desired temperature even when it is subject to a high temperature environment such as in a reflow furnace.

A temperature of heat-treatment may be, but not particularly limited to, a temperature higher, for example 30° C. higher, 80° C. higher, or 100° C. higher than a temperature to which the protection device is exposed, for example a temperature upon soldering for surface-mounting, specifically a temperature of a reflow furnace.

The period for the heat-treatment may be, but not particularly limited to, 1-180 minutes, for example 10 minutes, 20 minutes, 30 minutes, 60 minutes or 120 minutes.

The temperature and the period of the heat-treatment can be varied depending on the temperature to which the protection device is exposed, a kind of metal constructing the bimetal component, a size and a shape of the bimetal component, and the like.

Preferably, the heat-treatment is performed under an inert atmosphere, for example under a nitrogen atmosphere.

Although not shown, the bimetal component 18 may preferably have a protrusion, for example, a dome-shaped convex part on near the center of its lower surface (a side facing to the PTC component) (not illustrated). When the bimetal component 18 is activated and becomes the downwardly convex state from the upwardly convex state, this protrusion comes in contact with the PTC component 16. Since the arm 20 is extra pushed upwardly by a distance corresponding to the height of the protrusion, the arm is sufficiently pushed up even when the degree of curvature of the bimetal component 18 itself is smaller, and therefore, the electrical connection at the contact between the arm and the first terminal can mole surely be cut off.

In the protection device of the present invention, the arm 20 is positioned over the bimetal component 18 and is electrically connected to the second terminal 4. A method for connecting the arm 20 and the second terminal 4 includes, but is not limited to, soldering, welding, or the like, and it is preferable to use a laser welding. Alternatively the arm 20 and the second terminal may be integrally formed originally.

As illustrated, it is preferable that the arm 20 is formed into a bent shape such that the contact part which contacts with the first terminal is positioned somewhat lower with respect to a horizontal direction (a direction along which the bottom surface of the resin base extends). This contact part contacts with the contact part of the first terminal in the nominal state, while the bimetal component 18 deforms in the abnormal state thereby pushing the arm 20 upwardly, as the result of which the contacting state is dissolved.

The arm 20 may have the contact part 36 formed by swaging a contact material into a hole provided though the arm 20 as a contact part which contacts with the first terminal 2. By forming such contact part 36 in the arm 20, the contact part can have a larger thermal capacity, as the result of which a temperature rise of the contact parts can be prevented even when a relatively larger current flows though the protection device, so that the holding current of the protection device can be increased. It is noted that though it is sufficient that any one of the contact part of the first terminal 2 and the contact part of the arm 20 is formed by swaging the contact material through the first terminal or the arm, it is preferable that both contact parts are formed by swaging the contact materials.

A metal constituting the contact material of the arm 20 is the same as that constituting the contact part of the first terminal 2.

The arm 20 may have contact 34 to further ensure an electrical connection between the arm and the bimetal component when the bimetal component deforms in the abnormal state.

As illustrated, the arm 20 is preferably bent into a crank shape in the space 12. By applying such a shape, when the arm 20 is pushed, upwardly by the bimetal component 18 in the abnormal state, a distance between the contact part of the first terminal 2 and the contact part of the arm 20 (a contact gap) can be increased, so that the contacting state between both contact parts can be surely dissolved.

In the protection device of the present invention, an upper plate 26 is disposed over the arm in the space 12. The upper plate 26 has a function that, when the bimetal component 18 reaches a prescribed high temperature and it is activated to push the arm 20 upwardly, the upper plate comes in contact with the arm 20 which may be in a heated state caused by the heat from the bimetal component 18 at a prescribed high temperature, thereby dissipating the heat. Therefore, it is preferable that the upper plate 26 has superior thermal conductivity. The heat is dissipated via the second terminal 4 through the arm which is in contact with the upper plate from the upper plate 26. Therefore, the upper plate 26 is formed of for example a metal sheet. As a result, a quantity of heat transmitted from the bimetal component 18 to the resin cover 8 can be decreased as much as possible to minimize the effect on the resin cover 8 caused by the heat.

In the protection device of the present invention, the resin cover 8 is disposed such that it covers the upper plate 26. The resin cover 8 defines the resin housing 10 together with the resin base 6. The resin cover 8 and the resin base 6 can be bonded, for example, by using an adhesive, an ultrasonic welding, a laser welding or the like, and it is preferable to use the laser welding.

In one embodiment, a portion of an upper surface of the upper plate 26 may be exposed from the resin cover 8. By applying such structure, a heat generated inside the protection device, in particular the heat generated at the contact can be efficiently dissipated, and thereby the holding current of the device can be increased.

The resin constituting the resin cover 8 may be, but not particularly limited to, the same resin as or the different resin from the resin constituting the resin base 6. It is preferable that it is a thermal resistant resin. When the same resin as the resin constituting the resin base 6 is used, the boning between the resin base 6 and the resin cover 8 can be further ensued.

It is preferable that the protection device of the present invention has an appearance which is bilaterally symmetric between its left half including the first electrode and its right half including the second electrode. In the other words, it is preferable that the protection device symmetric with respect to a plane perpendicular to a plane containing a centerline ($y_1$-$y_2$ in FIG. 3) between the exposed portion of the first electrode and the exposed portion of the second electrode at the bottom surface of the protection device. By applying such structure, when the protection device is provided, it can be located in any direction without identifying the positive electrode and the negative electrode and right and left.

INDUSTRIAL APPLICABILITY

The protection device of the present invention can be suitably used as a protection device in a lithium ion battery in a mobile phone, a tablet apparatus or the like.

The element reference numbers are:

1—protection device;
2—first terminal;
4—second terminal;
6—resin base;
8—resin cover;
10—resin housing;
12—space;
14—exposed portion;
16—PTC component;
18—bimetal component;
20—arm;
22—first electrode;
24—second electrode;
26—upper plate;
28—section of first terminal;
30—step part;
32—contact;
34—contact;
36—contact part

What is claimed is:

1. A protection device comprising a resin base, a first terminal, a second terminal, a PTC component, a bimetal component, an arm, an upper plate and a resin cover wherein a portion of the first terminal configures a first electrode, and a portion of the second terminal configures a second electrode, the first electrode and the second electrode extend around to form at least a portion of a side surface and a flat bottom surface such that the first and second electrodes are exposed outward and lie in the same plane as a flat bottom surface of the resin base, the first terminal having a rib at an end opposite of the side surface and the flat bottom surface of the first electrode and extending into a space of the resin base to contact the PTC component, in a normal state, the first terminal, the arm and the second terminal are electrically connected in series, and when the bimetal component is activated, the first terminal and the arm becomes electrically cut off while the first terminal, the PTC component, the bimetal component, the arm and the second terminal are electrically connected in series in thus mentioned order.

2. The protection device according to claim 1, wherein the bimetal component has been subjected to a heat-treatment.

3. The protection device according to claim 2, wherein a temperature of the heat-treatment is higher than a temperature of a soldering for surface-mounting the protection device.

4. The protection device according to claim 1, wherein the first terminal has a contact part formed by swaging a contact material through a hole of the first terminal, the contact material having a larger thermal capacity than the first terminal.

5. The protection device according to claim 4, wherein the contact material is a silver-nickel alloy.

6. The protection device according to claim 1, wherein the resin base is formed from a thermal resistant resin.

7. The protection device according to claim 1, wherein the upper plate has an engaging part having a hook-like shape and is fixed on the resin base by engaging the engaging part to an engaged part having a notch shape of the resin base.

8. The protection device according to claim 1, wherein the arm has a crank shape portion in the space of the resin base.

9. The protection device according to claim 1, wherein the exposed portions of the first terminal and/or the second terminal are plated with a metal unsusceptible to oxidation.

10. The protection device according to claim 9, wherein the metal unsusceptible to oxidation is gold.

11. The protection device according to claim 1, wherein the first electrode and the second electrode are provided so as to be line-symmetric with respect to a center line between the first electrode and the second electrode at the bottom surface of the resin base.

12. A protection device comprising:

a resin base having a flat bottom surface and surrounding side surfaces;

a first terminal extending around to form at least a portion of a side surface and a flat bottom surface, the first terminal including a first electrode, wherein the first electrode is exposed outward and lies in the same plane as the flat bottom surface of the resin base;

a second terminal extending around to form at least a portion of a side surface and a flat bottom surface opposite the first terminal, the second terminal including a second electrode, wherein the second electrode is exposed outward and lies in the same plane as the flat bottom surface of the resin base and the first electrode;

a PTC component disposed in a space formed of the resin base, the first terminal, and the second terminal, wherein the first terminal includes a rib at an end opposite of the side surface and the flat bottom surface of the first electrode to extend into a space of the resin base to contact the PTC component, a bimetal component disposed over the PTC component; and an arm extending over the bimetal component and having an end connected to the second terminal and removably attachable to the first terminal;

wherein in a normal state, the first terminal, the arm, and the second terminal are electrically connected in series; and wherein when the bimetal component is activated, the first terminal and the arm becomes electrically cut off while the first terminal, the PTC component, the bimetal component, the arm and the second terminal are electrically connected in series order.

* * * * *